United States Patent [19]

Faasse et al.

[11] Patent Number: 4,750,526

[45] Date of Patent: Jun. 14, 1988

[54] HEDDLE FRAME FOR A HIGH SPEED WEAVING MACHINE

[75] Inventors: Gene E. Faasse, Greer; James E. Howard, Travelers Rest, both of S.C.

[73] Assignee: Steel Heddle Manufacturing Company, Greenville, S.C.

[21] Appl. No.: 86,283

[22] Filed: Aug. 17, 1987

Related U.S. Application Data

[63] Continuation-in-part of Ser. No. 896,980, Aug. 14, 1986, Pat. No. 4,687,030.

[51] Int. Cl.[4] ..... D03C 9/06

[52] U.S. Cl. ..... 139/91

[58] Field of Search ..... 139/91, 92

[56] References Cited

U.S. PATENT DOCUMENTS

| | | | |
|---|---|---|---|
| 3,335,759 | 8/1967 | Koch | 139/91 |
| 4,144,910 | 3/1979 | Bader | 139/91 |
| 4,349,052 | 9/1982 | Yaji et al. | 139/92 |

*Primary Examiner*—Henry S. Jaudon

*Attorney, Agent, or Firm*—Dority & Manning

[57] ABSTRACT

A heddle frame having a pair of hollow laterally extending cross rails and a pair of end braces connected to adjacent ends of the cross rails to form a rectangular frame. A quick release connection is provided between the end braces and the laterally extending cross rails which includes a connector which is fixed within an opening in the cross rail which has means for compressively gripping a projection which extends at right angles from the end brace. The projection has a width which is less than the width of the opening into which it extends and the connector is resiliently connected to the walls of the hollow rail to provide a connection between the end brace and a cross rail which is rigid when not under stress but which permits limited relative movement of the cross rails and the end braces whenever the cross rails are under stress. The resilient connection includes an insert of synthetic material, or an elastomeric material such as polyurethane into which is fitted two or more bushings for the reception of metal fasteners which fasten the insert securely to the wall of the hollow cross rail.

11 Claims, 2 Drawing Sheets

FIG.1
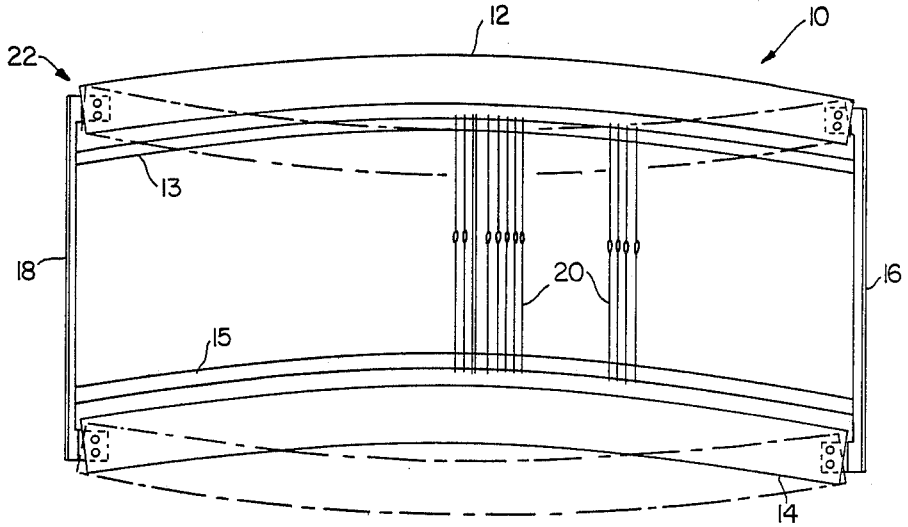
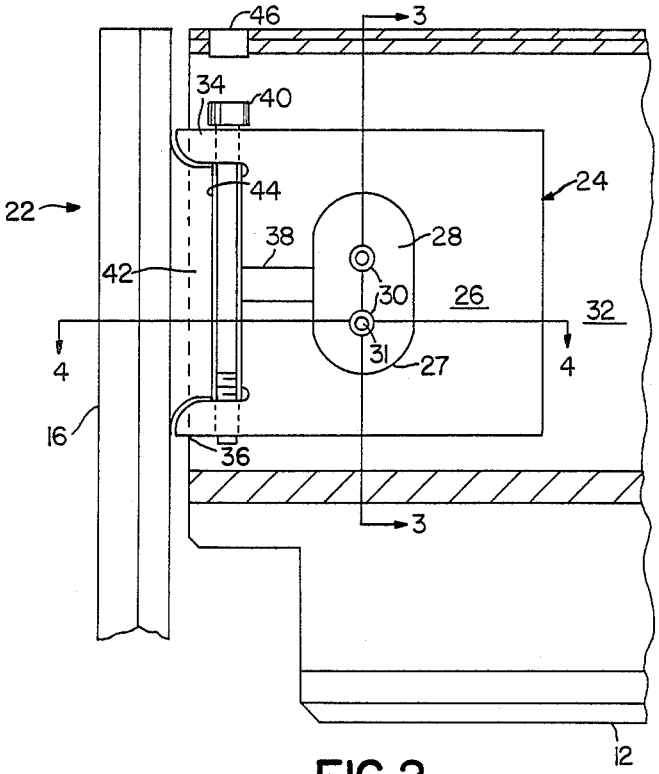
FIG.2
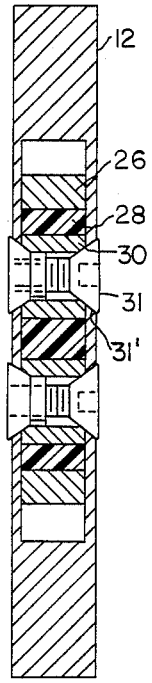
FIG.3

HEDDLE FRAME FOR A HIGH SPEED WEAVING MACHINE

This application is a Continuation-In-Part of U.S. patent application Ser. No. 06/896,980, filed on Aug. 14, 1986, now U.S. Pat. No. 4,687,030, in the name of Gene E. Faasse, and assigned to applicant's assignee.

BACKGROUND OF THE INVENTION

The present invention relates to high speed weaving machines, and more particularly, to the heddle frames for use on high speed weaving machines.

In the past, heddle frames used in weaving machines were composed of a pair of end braces and a pair of laterally extending rails. The end braces were conventionally, rigidly attached to the top and bottom rails at each end. The end braces were free to slide in a guiding groove on a support on the weaving machine to form the shed during the weaving operation. With the advent of high speed weaving machines, which make as many as 300 to 600 sheds per minute, the reciprocating motion of the heddle frame was very rapid and the inertia of the heddle frame, owing to its weight, was very great. This caused frequent breaking of the heddle frames, particularly at the connection between the end braces and the top and bottom rails.

In an attempt to overcome such defects and to reduce the inertia of the heddle frame, the top and bottom rails have been made of light weight hollow aluminum beams. However, the aluminum rails are subjected to substantial bending which exerts a flexing movement on the connection between the end brace and the top and bottom rails. This flexing action results in fatigue of the metal comprising the end braces or the rails or both, thereby causing frequent failure of the heddle frame.

Several attempts have been made to overcome the problems created by the high speed weaving machines. One such attempt is shown in U.S. Pat. No. 4,022,252 issued May 10, 1977 to Hiroshi Ogura. In this patent, the end brace has a metal core, a portion of which is covered with plastic to provide additional strength. A pair of joining pieces project from the strengthened portion of the core of the end brace, as one body and form a tapered groove therebetween. These projections extend into the hollow body of the cross rails. The end brace is anchored to the cross rails by means of a wedge shaped member which is attached to the end brace by screws. The wedge shape member enters the tapered groove, formed by the projecting pieces, so as to force the projecting pieces against the side walls of the cross rail, locking the end brace firmly to the cross rails. This joint is relatively rigid in that the projected pieces are firmly forced against the walls of the cross rail and provides little or no flexibility between the end brace and the cross rails. This arrangement makes for a stronger connection between the end brace and the cross rails but does not provide for the flexibility of the connection which is necessary to avoid unduly flexing or fatiguing the metal making up the end braces or the cross rails.

Another attempt to resolve the defects and deficiencies of the prior art heddle frames is shown in U.S. Pat. No. 4,230,159 issued Oct. 28, 1980 to Yoichi Shimizu. In this patent, the end brace is joined to the cross rail by means of a plastic projection which extends into the hollow space of a cross rail and is pinned to the cross rail by a single pin which permits the projection to pivot about the pin to provide for a flexible joint. A packing material 11 is packed in the space between the end brace and the cross rail to dampen the noise or pivoting action between the end brace and cross rail. This permits flexibility of the joint but it is a design that cannot be readily disassembled for drawing in of the warps or for replacing component parts.

Most of the shortcomings noted above have been overcome in U. S. patent application Ser. No. 06/896,980, However, while the heddle frame of this application overcame and avoided the deficiencies of the prior art, it is not easy to disconnect the end brace from the top or the bottom rail, as the case may be. In one embodiment of the harness frame of this application, it is necessary to remove two bolts at each end connection in order to disconnect the end brace from the projection therefrom or from the sidewalls of the rails. When this was done, it was necessary to store the bolts removed during the disconnection operation and to retain them for later use when the end brace is again attached to the projection.

In another embodiment of said application's harness frame, the projection is made integral with the end brace and is bolted or riveted to the sidewalls of the rail. In order to disconnect the rail from the end brace in this embodiment, it is again necessary to remove the two bolts that hold the projection to the sidewalls of the rail or to knock out the rivets in the case where the rivets are used to connect the projection to the sidewalls. In either case, this becomes a time consuming process and requires the storage of the bolts removed from the rail, and in the case of the rivets, required the insertion of new rivets whenever the end brace was to be fastened to a new rail.

SUMMARY OF THE INVENTION

Accordingly, it is an object of the present invention to provide an improved heddle frame having a simplified connection between the cross rail and the end brace.

Another object of the present invention is to provide an improved heddle frame which has resistance to cutting and breaking the connection between the end brace and the cross rail, caused by the bending of the metal and fatiguing of the metal.

Another object of the present invention is to provide a heddle frame which is quickly and easily disassembled for repairs or for drawing in new warps into the heddle eyes.

Yet another object of the invention is to provide a heddle frame which has a rigid but flexible connection between the end braces and the top and bottom rails and which will permit relative movement between the end braces and the rails under stress but still present a firm connection between the end braces and the rails at each connection.

BRIEF DESCRIPTION OF THE DRAWING

Other objects of the present invention will be more fully appreciated as the invention becomes better understood from the following detailed description of the present invention, when considered in connection with the accompanying drawings, wherein like reference characters designate like or corresponding parts, and in which:

FIG. 1 is a front view of a heddle frame of a high speed weaving machine according to the present invention;

FIG. 2 is an enlarged front view, partially in section, illustrating the connection between the end brace and the top cross rail;

FIG. 3 is a sectional view taken along line 3—3 of FIG. 2;

DETAILED DESCRIPTION OF THE DRAWING

Figure 4:
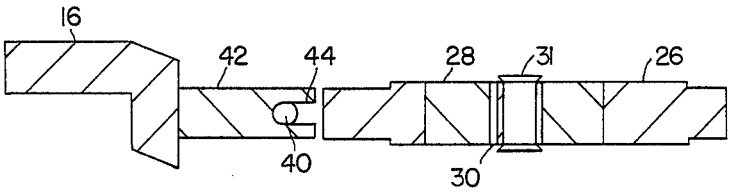
FIG. 4 is a sectional view taken along line 4—4 of FIG. 2.

Referring now to FIG. 1 of the drawing, a heddle frame 10 is shown having a pair of cross rails 12 and 14 and a pair of end braces 16 and 18. Cross rails 10 and 14, respectively, carry heddle bars 13 and 15 on which are mounted a plurality of heddles 20. The cross rails are preferably formed of a hollow aluminum beam and the end braces have projections which extend into the hollow aluminum cross rail for a releasable connection with a connector assembly anchored to the walls of the cross rail. As seen in FIG. 1, cross rails 12 and 14 are subjected to substantial distortion during the operation of the weaving machine as noted by the full line and the dotted line positions of the cross rails. The bending of the cross rails exerts considerable stress upon the end braces 16 and 18 and in particular, upon the connection between the cross rails and the end braces.

FIGS. 2, 3 and 4 illustrate a first embodiment of the connection between the end brace and the cross rail. In this embodiment, a connection 22 comprises a connector assembly 24 which in turn has a connector 26. Connector 26 has a centrally disposed opening 27 which extends through connector 26. Disposed within opening 27 is an insert 28 composed of a synthetic polymer or an elastomeric polymer. Spaced within insert 28 are two metal sleeves or bushings 30 which extend from one side of the insert to the other. Insert 28 is rigidly connected to the walls of each of the rails by means of bevel headed bolts or rivets 31.

Connector 26 has two spaced upper and lower extensions 34 and 36, respectively, extending from the connector towards the end brace 16. Upper connector 34 has a smooth bore through which a compression bolt 40 extends and bolt 40 is threaded into lower extension 36. Intermediate upper and lower connector extensions 34 and 36 is a compression slot 38 which extends from the outer surface of connector 26 into opening 27.

End brace 16 has integrally therewith, a projection 42 which has a height which corresponds to the space between upper extension 34 and lower extension 36 when no compression is exerted thereon by compression bolt 40. Projection 42 has a vertical U-shaped opening or slot 44 which is adapted to extend about compression bolt 40. Alternatively, the base of the U-shaped opening may be tapered inwardly and the upper and lower extensions 34 and 36 correspondingly modified to provide a dovetail fit for projection 42. An opening or hole 46 is provided in the top of the cross rail for ease of access to bolt 40 by means of an allen screw wrench.

Whenever it is desired to connect an end brace 16 to the cross rail 12, the end brace 16 is brought into place with its projection 42 entering the space between the upper and lower extensions 34 and 36 and its U-shaped slot 44 extending around compression bolt 40. Compression bolt 40 is then tightened by means of an allen screw wrench to draw the upper and the lower extensions 34 and 36 together to provide a rigid and snug connection between projection 42 and connector 26. Space is provided between the cross rail 12 and the end brace 16 to permit limited vertical movement or bowing of the cross rail as shown in FIG. 1.

Whenever it is desired to exchange end brace 16 or the cross rail 12 for repair or the like, it is merely necessary to rotate compression bolt 40 one or two turns to permit easy and quick removal of projection 42 from its compression connection with extensions 34 and 36 of connector 26. It is not necessary to remove bolt 40 from its threaded relationship in extension 36. Thus, it is not necessary to store the bolt 40 for future use since bolt 40 is retained in insert 26.

Figure 5:
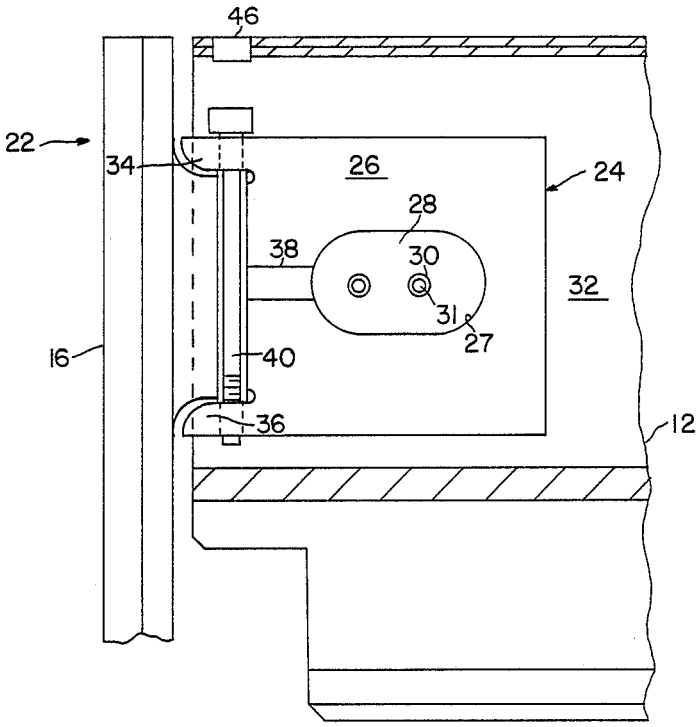
FIG. 5 is a view similar to FIG. 2, illustrating a modification of the connection between the connector assembly and the top rail.

Referring now to FIG. 5, wherein a second embodiment of the connection between the cross rail and the connector 26 is shown. In this embodiment, connector 26 is connected to walls 32 of top rail 12 by two laterally spaced screws, bolts or rivets 31 rather then the vertically spaced bolts 31 in the embodiment of FIG. 2. In this embodiment, the connection of the end brace with the insert is the same as it was in the embodiment of FIG. 2.

While two embodiments of the invention have been illustrated and described herein, it will be readily apparent to those skilled in the art that other variations of the structure shown herein could be made without departing from the essential features of the invention. It is therefore to be understood that within the scope of the appended claims, the invention may be practiced otherwise therein as specifically described herein.

What is claimed is:

1. In a heddle frame having a pair of laterally extending cross rails and a pair of end braces connected to adjacent ends of said pair of cross rails to form a rectangular frame, wherein each of the connections between said end braces and said laterally extending cross rails comprise:

(a) an elongated opening within the end of said cross rail;

(b) a connector disposed within said elongated opening, having a width which is less than the width of said opening;

(c) means to resiliently connect said connector to said cross rail;

(d) a projection extending laterally from said end brace into said opening in said cross rail, said projection having a width which is less than the width of said opening; and (e) means for compressively connecting said projection to said connector within said opening, whereby said projector is rigidly connected to said connector, thereby providing a connection between said end brace and said cross rail which is rigid when not under stress but which has limited flexiblity to permit limited vertical movement of the cross rails relative to the end brace whenever the cross rails are under vertical stress.

2. In a heddle frame as set forth in claim 1, wherein said connector is connected to side walls of said cross rail by mechanical means.

3. In a heddle frame as set forth in claim 2, wherein said mechanical means comprise bolts.

4. A heddle frame as set forth in claim 1, wherein said connector has a centrally disposed opening with an insert of resilient material therein, and said mechanical means anchors said insert to the side walls of said cross rail.

5. In a heddle frame as set forth in claim 1, wherein said connector assembly has spaced extensions extending towards the end of the cross rail and towards said end brace, and said projection extends between said spaced extensions.

6. In a heddle frame as set forth in claim 5, wherein each of said spaced extensions have a bore extending therethrough and a compression bolt for drawing said extensions together to clamp the projection to said connector.

7. In a heddle frame as set forth in claim 6, wherein said connector is provided with a compression slot extending from the outside edge of said connector, between said spaced extensions to the central opening therein, to assist the compression bolt in drawing the surfaces of said extensions against the sides of the projection.

8. In a heddle frame having a pair of laterally extending cross rails and a pair of end braces connected to adjacent ends of said pair of cross rails to form a rectangular frame, wherein each of the connections between said end braces and said laterally extended cross rails comprise:

(a) an elongated opening within the end of said cross rail;

(b) a projection extending laterally from said end brace into said opening in the cross rail, wherein the width of said projection is less than the width of said opening;

(c) a connector disposed within said opening and resiliently connected to side walls of said cross rail to provide a connection with said cross rails which is rigid when not under stress but which has limited flexibility to permit limited vertical movement of said cross rails relative to the end braces when the cross rails come under vertical stress; and (d) compression means for attaching said projection to said connector to firmly anchor the end brace to said connector and thereby to said cross rail.

9. In a heddle frame as set forth in claim 8, wherein said connector is provided with laterally extending spaced extensions extending from said connector towards said end brace, spaced a distance which is slightly greater than the width of said projection.

10. In a heddle frame as set forth in claim 9, wherein means are provided for drawing said spaced extensions together, causing them to grip said projection firmly therebetween.

11. In a heddle frame as set forth in claim 10, wherein said projection is provided with a U-shaped slot on its outer end and said compression means comprises a bolt which extends from one of said extensions through said U-shaped slot into the other of said extensions.

* * * * *